US010231524B2

(12) United States Patent
Tonelli et al.

(10) Patent No.: US 10,231,524 B2
(45) Date of Patent: Mar. 19, 2019

(54) LOCKING ASSEMBLY FOR PORTABLE CONTAINERS, AND RELATED CONTAINER

(71) Applicant: G.T. Line S.R.L., Frazione Crespellano (IT)

(72) Inventors: Massimo Tonelli, Casalecchio di Reno (IT); Alessio Concettoni, Ancona (IT)

(73) Assignee: G.T. LINE S.R.L., Frazione Crespellano (IT)

( * ) Notice: Subject to any disclaimer, the term of this patent is extended or adjusted under 35 U.S.C. 154(b) by 133 days.

(21) Appl. No.: 15/103,255

(22) PCT Filed: Dec. 10, 2013

(86) PCT No.: PCT/IT2013/000344

§ 371 (c)(1),
(2) Date: Jun. 9, 2016

(87) PCT Pub. No.: WO2015/087358

PCT Pub. Date: Jun. 18, 2015

(65) Prior Publication Data

US 2016/0302544 A1 Oct. 20, 2016

(51) Int. Cl.
*A45C 5/00* (2006.01)
*A45C 13/10* (2006.01)
(Continued)

(52) U.S. Cl.
CPC ..... *A45C 13/1084* (2013.01); *B65D 45/24* (2013.01); *E05B 65/523* (2013.01);
(Continued)

(58) Field of Classification Search
CPC ... A45C 13/1084; B65D 45/24; E05B 65/523; E05B 65/5269; E05B 3/12; E05B 19/12
See application file for complete search history.

(56) References Cited

U.S. PATENT DOCUMENTS 202,186 A * 4/1878 Montgomery ..... 292/139
847,751 A * 3/1907 Faix ..... E05B 63/0017 292/140
(Continued)

FOREIGN PATENT DOCUMENTS

CN 1644860 A 7/2005
CN 1834393 A 9/2006
(Continued)

OTHER PUBLICATIONS

International Search Report dated Sep. 3, 2014 re: Application No. PCT/IT2013/000344; pp. 1-3; citing: U.S. Pat. No. 3,534,992 A, U.S. Pat. No. 3,008,320 A and U.S. Pat. No. 6 032 988 A.
(Continued)

*Primary Examiner* — Tri Mai
(74) *Attorney, Agent, or Firm* — Cantor Colburn LLP

(57) ABSTRACT

A locking assembly for portable containers includes at least one open shell that defines within it a compartment for accommodating objects. The shell is partially closed, in a first configuration, by at least one respective covering unit coupled to the shell and moves between two configurations for free access to the compartment. The locking assembly includes at least one lever for actuating a slider, which can be coupled to a reference outer surface of the shell or the unit. The slider moves between a first limit position, wherein it is engaged with a respective abutment coupled to the other one of the shell or the unit, arranged in the first configuration, for theft mutual locking, and second limit position, wherein the slider is distanced from the abutment to allow the transition of the covering unit between the configurations and free access to the compartment.

13 Claims, 7 Drawing Sheets

(51) Int. Cl.

| | |
|---|---|
| ***B65D 45/24*** | (2006.01) |
| ***E05B 65/52*** | (2006.01) |
| ***E05C 3/12*** | (2006.01) |
| ***E05C 19/12*** | (2006.01) |

(52) U.S. Cl.
CPC ..... *E05B 65/5269* (2013.01); *E05C 3/12* (2013.01); *E05C 19/12* (2013.01)

(56) References Cited

U.S. PATENT DOCUMENTS 2,472,285 A * 6/1949 Claud-Mantle ..... E05C 19/14 16/232
3,008,320 A 11/1961 Martin et al.
3,034,327 A * 5/1962 Garmon, Jr. ..... E05B 65/5238 190/121
3,534,992 A * 10/1970 Swanson ..... E05C 19/14 292/113
4,627,650 A * 12/1986 Hauschulte ..... E05C 19/14 292/113
6,032,988 A 3/2000 Klein
6,547,293 B1 * 4/2003 Cheng ..... E05C 19/14 292/113
8,297,464 B2 * 10/2012 Grenier ..... A45C 13/1084 220/314
8,985,654 B2 * 3/2015 Marshall ..... A47J 45/10 294/16
2006/0255596 A1 * 11/2006 Yong ..... E05C 1/14 292/173

FOREIGN PATENT DOCUMENTS

CN 201447969 U 5/2010
CN 201460516 U 5/2010

OTHER PUBLICATIONS

CN Office Action dated Mar. 3, 2017 re: Application No. 201380081592.8; pp. 1-10; citing: U.S. Pat. No. 3,534,992A, U.S. Pat. No. 3,008,320A, CN201447969U, CN201460516U, CN1644860A, CN1834393A and U.S. Pat. No. 6,032,988A.

* cited by examiner

LOCKING ASSEMBLY FOR PORTABLE CONTAINERS, AND RELATED CONTAINER

TECHNICAL FIELD

The present disclosure relates to a locking assembly for portable containers, and related container.

BACKGROUND

Nowadays, portable containers (of the type of suitcases, trunks, trolley cases etc.) are widely used, and are constituted by two half-shells which are mutually articulated and are kept in the closed configuration by one or more locking elements (or locks), which are deactivateable on command in order to allow access to the internal compartment of the container.

Some of these containers, in order to meet specific requirements of some market segments and of various classes of professional users, must further be capable of ensuring a high resistance to shocks (without deformations of the structure and, still less, damage to what is being transported inside) and a total hermetic seal (thus preventing infiltrations into the compartment of water, air, dust and the like).

To this end, use is thus made of locking elements that, in the closed configuration of the container, are capable of mutually locking, and with force, two respective lips which protrude from the half-shells, and which are usually provided with perimetric gaskets.

In more detail, such elements comprise a clamp, which is articulated to one of the lips and is provided, at the opposite end, with a curved appendage that can engage elastically with the other lip, so as to achieve the desired mutual locking, when the two half-shells of the container are arranged in the closed configuration.

Such implementation solution is not however devoid of drawbacks.

Precisely because of the necessity to ensure the hermetic seal and excellent locking, even in the event of violent impacts, it is necessary to overdimension the clamp (and more generally the closure element) and/or to arrange a plurality of clamps along the protruding lips: this results first of all in an unwanted increase in the cost, structural complexity and, especially, the space occupation of the element, which on the contrary should be kept as small as possible (as will be made clearer in the following paragraphs).

Such necessities are evidently even more felt (and with them the drawbacks mentioned earlier) for bigger containers: in these in fact the surfaces of the half-shells, which are very extensive, are more subject to bending stresses, and can thus easily warp and be deformed during use, thus impairing the correct coupling at the lips (and thus compromising the seal).

In addition, it should be noted that often the manufacturers are forced to use levers, release buttons and other, similar contrivances, in order to enable the user to actuate the clamps with which the containers are provided, without requiring excessive effort.

This further increases the complexity, cost and space occupation of the closing elements described above, thus in fact exacerbating the drawbacks explained above.

It thus appears evident that trunks, suitcases and trolley cases of the type described above are provided externally with closing elements that are excessively cumbersome, and thus are such as to be above all inconvenient per se.

In addition, they are found to be entirely inadequate when the available space, as very often happens, is greatly limited by the mandatory presence of handles, padlocks, labels, openable doors, or by other construction-related requirements. Such elements in fact do not make it possible to find a convenient placement for the closing elements (and sometimes even for the protruding lips), still less leave available the space necessary for the rotation of their moving parts, during opening and closing.

SUMMARY

The aim of the present disclosure is to solve the above mentioned problems, by providing a locking assembly for containers, which offers contained dimensions and space occupation.

Within this aim, the disclosure provides a container that is provided with one or more locking assemblies of contained dimensions and space occupation.

The disclosure further provides a locking assembly that can be used on a container, possibly involving a large number thereof, without interfering significantly with the other elements and accessories of the container.

The disclosure also provides a container that is provided with one or more locking assemblies which are such as to ensure high resistance to shocks and a total hermetic seal.

The disclosure further provides a locking assembly that is low cost and can be applied on a container, without imposing significant construction modifications on the latter.

The disclosure also provides a locking assembly that ensures a high reliability of operation.

Also, the disclosure provides a locking assembly that can be easily implemented using elements and materials that are readily available on the market.

Furthermore, the disclosure provides a locking assembly that is safely applied.

The disclosure provides a locking assembly for portable containers, of the type of trunks, suitcases, trolley cases, and the like, which comprise at least one open shell that internally defines a compartment for accommodating objects and is at least partially closed, in at least one first configuration, by at least one respective covering unit, which is coupled to the shell and can move between the first configuration and at least one second configuration, for free access to the compartment, characterized in that it comprises at least one lever for actuating at least one slider, which can be slideably coupled to a reference outer surface of either the shell or the unit, said slider being able to move between at least one first limit position, in which it is engaged with a respective abutment which can be coupled to the other one of either the shell or the unit, arranged in the first configuration, for their mutual locking, and at least one second limit position, in which said slider is distanced from said abutment, in order to allow the transition of the covering unit from the first configuration to the second configuration and free access to the compartment.

The disclosure also provides a portable container, of the type of trunks, suitcases, trolley cases, and the like, which comprises at least one open shell that internally defines a compartment for accommodating objects and is at least partially closed, in at least one first configuration, by at least one respective covering unit, which is coupled to said shell and can move between said first configuration and at least one second configuration, for free access to said compartment, characterized in that it comprises a locking assembly that is provided with at least one lever for actuating at least one slider, which is slideably coupled to a reference outer surface of either said shell or said unit, said slider being able to move between at least one first limit position, in which said slider is engaged with a respective abutment which is coupled to the other one of either said shell or said unit, arranged in the first configuration, for their mutual locking, and at least one second limit position, in which said slider is distanced from said abutment, in order to allow the transition of said unit from said first configuration to said second configuration and free access to said compartment.

BRIEF DESCRIPTION OF THE DRAWINGS

Further characteristics and advantages of the disclosure will become better apparent from the description of a preferred, but not exclusive, embodiment of the lock and of the container according to the disclosure, which is illustrated by way of non-limiting example in the accompanying drawings wherein.

DETAILED DESCRIPTION OF THE DRAWINGS

Figure 2:
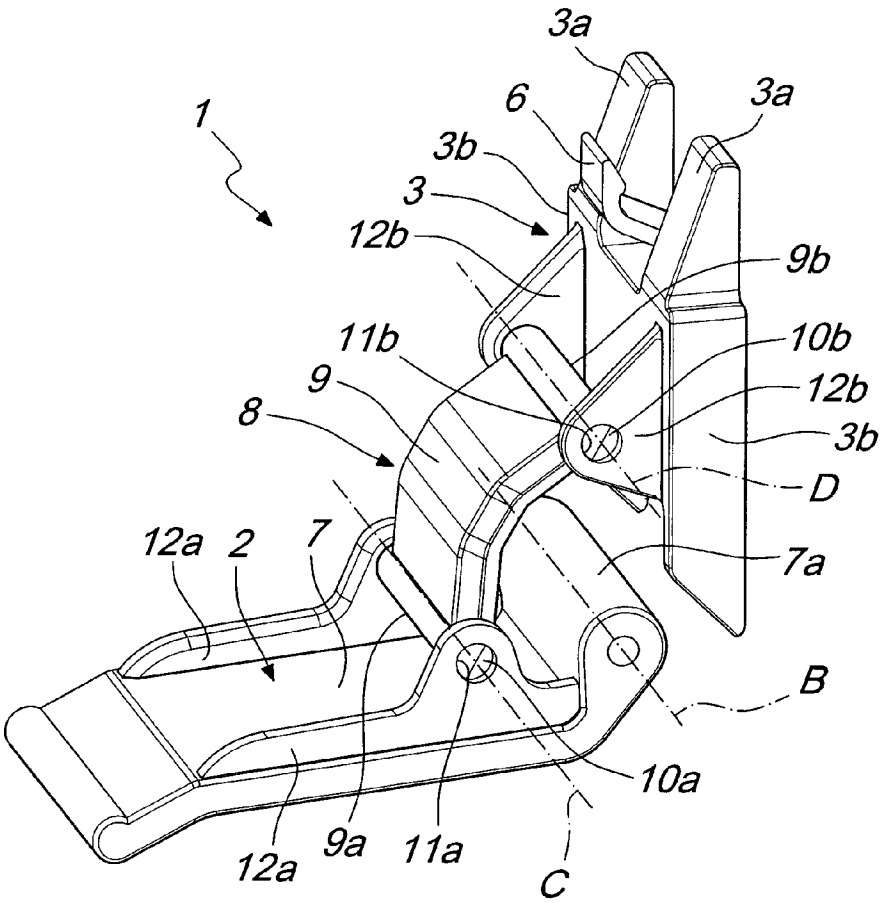
FIGS. 1 and 2 are schematic perspective views of the locking assembly according to the disclosure, in two conditions of use.

With particular reference to the figures, the reference numeral 1 generally designates a locking assembly for portable containers (in turn generally designated by the reference numeral 100), of the type of trunks, suitcases, trolley cases, and the like.

Figure 8:
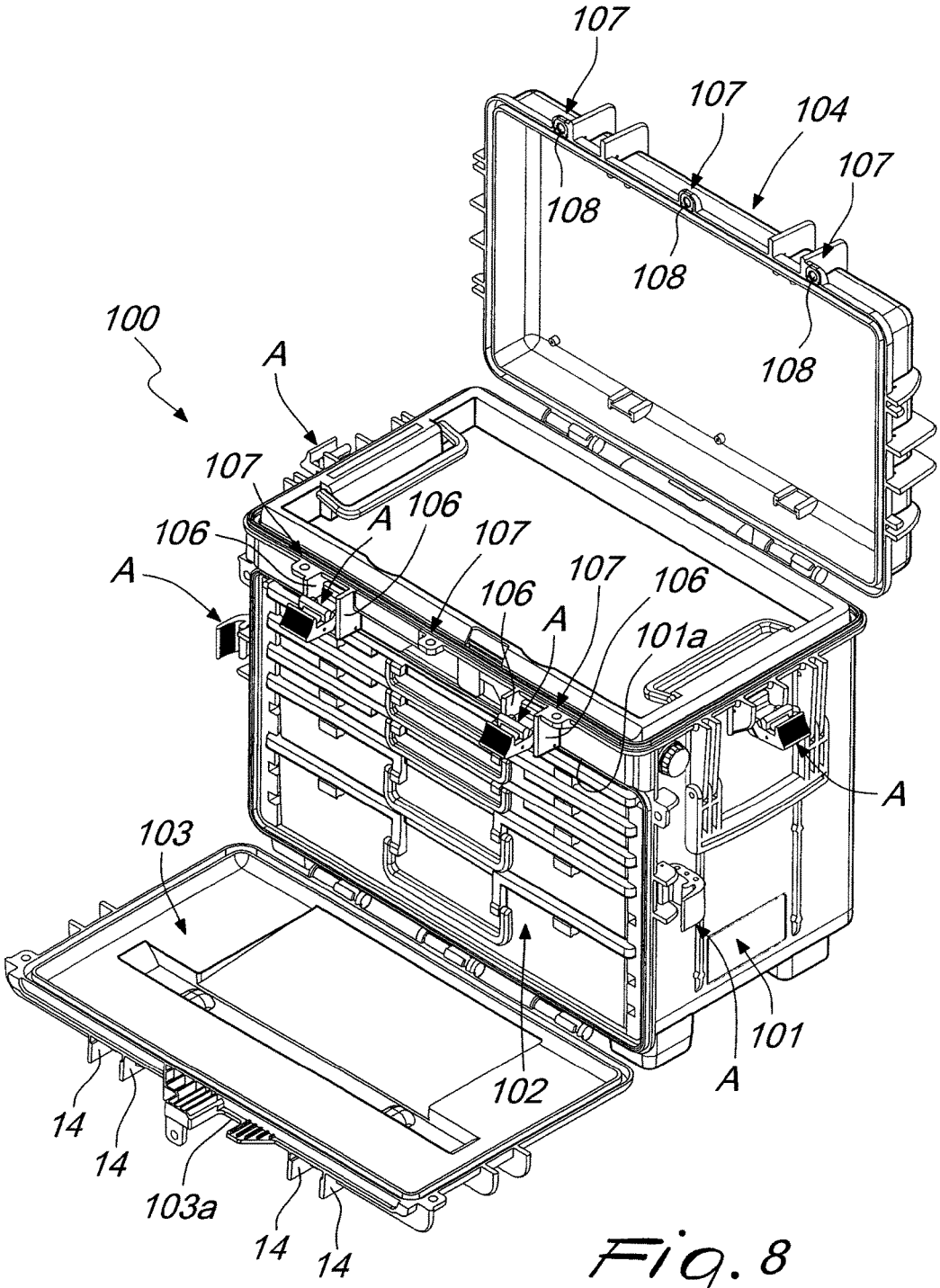
FIG. 8 is a perspective view of the container according to the disclosure, in the second configuration.

The container 100 comprises at least one open shell 101, which defines internally a compartment 102 for accommodating objects; the shell 101 is thus at least partially closed, in at least one first configuration, by at least one respective covering unit 103 (variously contoured, according to specific requirements) that is coupled to the shell 101 and can move between the first configuration (in which the container 100 is shown in FIGS. 3, 4, 5 and 6) and at least one second configuration (in which the container 100 is shown in FIG. 8), in order to allow a user free access to the compartment 102.

It should be noted from this point onward that the locking assembly 1 can be applied on any type of container 100 (for example those listed above and/or the one shown in the accompanying figures, but not only these), according to specific requirements.

In the peculiar embodiments of the container 100 shown for the purposes of non-limiting example in the accompanying figures, and as is evident for example from FIG. 8, the shell 101 is closed in front by the unit 103 (which in this case is constituted by a sort of flat panel) and on top by an additional cover 104. In such embodiment, two locking assemblies 1 according to the disclosure are used for the mutual locking of a perimetric rim 101*a* of the shell 101 with a respective perimetric flap 103*a* of the covering unit 103, while locking elements A of the conventional type are employed in order to complete, laterally, the coupling between the shell 101 and the covering unit 103 and in order to secure the cover 104 to the shell 101.

It should thus be noted that such embodiment of the container 100 and such employment of the assemblies 1 constitute the preferred, but not exclusive, application of the disclosure: the possibility in fact exists of arranging further assemblies 1 on the container 100 shown in the accompanying figures, just as the possibility is not excluded of using assemblies 1 in order to lock containers 100 of different type (and for example constituted by two half-shells of the conventional type which are mutually articulated, and thus maintained in the closed configuration by assemblies 1 according to the disclosure).

According to the disclosure, the locking assembly 1 comprises at least one lever 2 for actuating at least one slider 3, which can be slideably coupled to a reference outer surface 105 of either the shell 101 or the unit 103.

The slider 3 can move between at least one first limit position, in which it is engaged with a respective abutment 4 which can be coupled to the other one of either the shell 101 or the unit 103, when the latter is arranged in the first configuration, and at least one second limit position, in which the slider 3 is distanced from the abutment 4.

Figure 3:
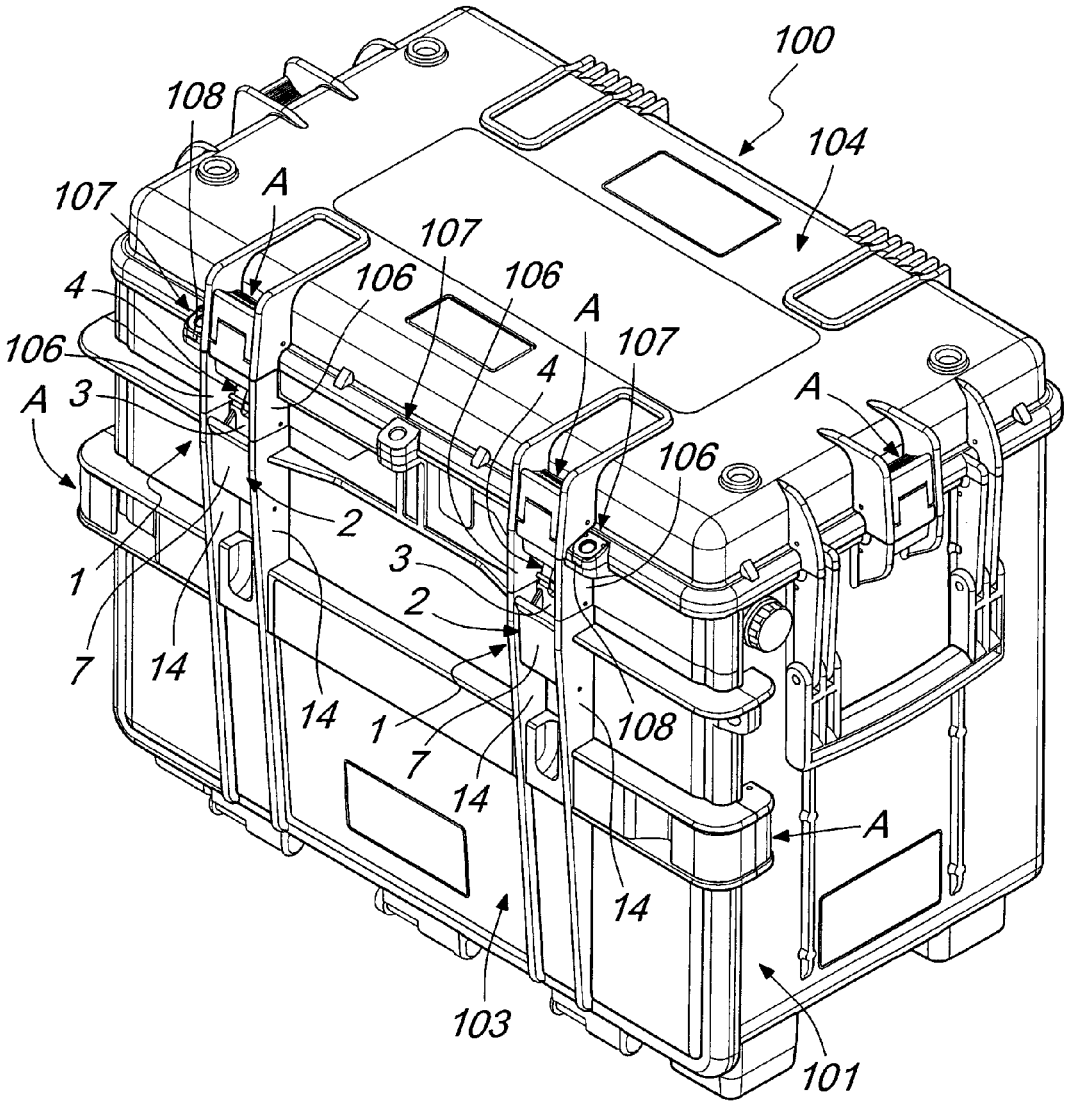
FIG. 3 is a perspective view of the container according to the disclosure in the first configuration, with the sliders in the first limit position.
Figure 4:
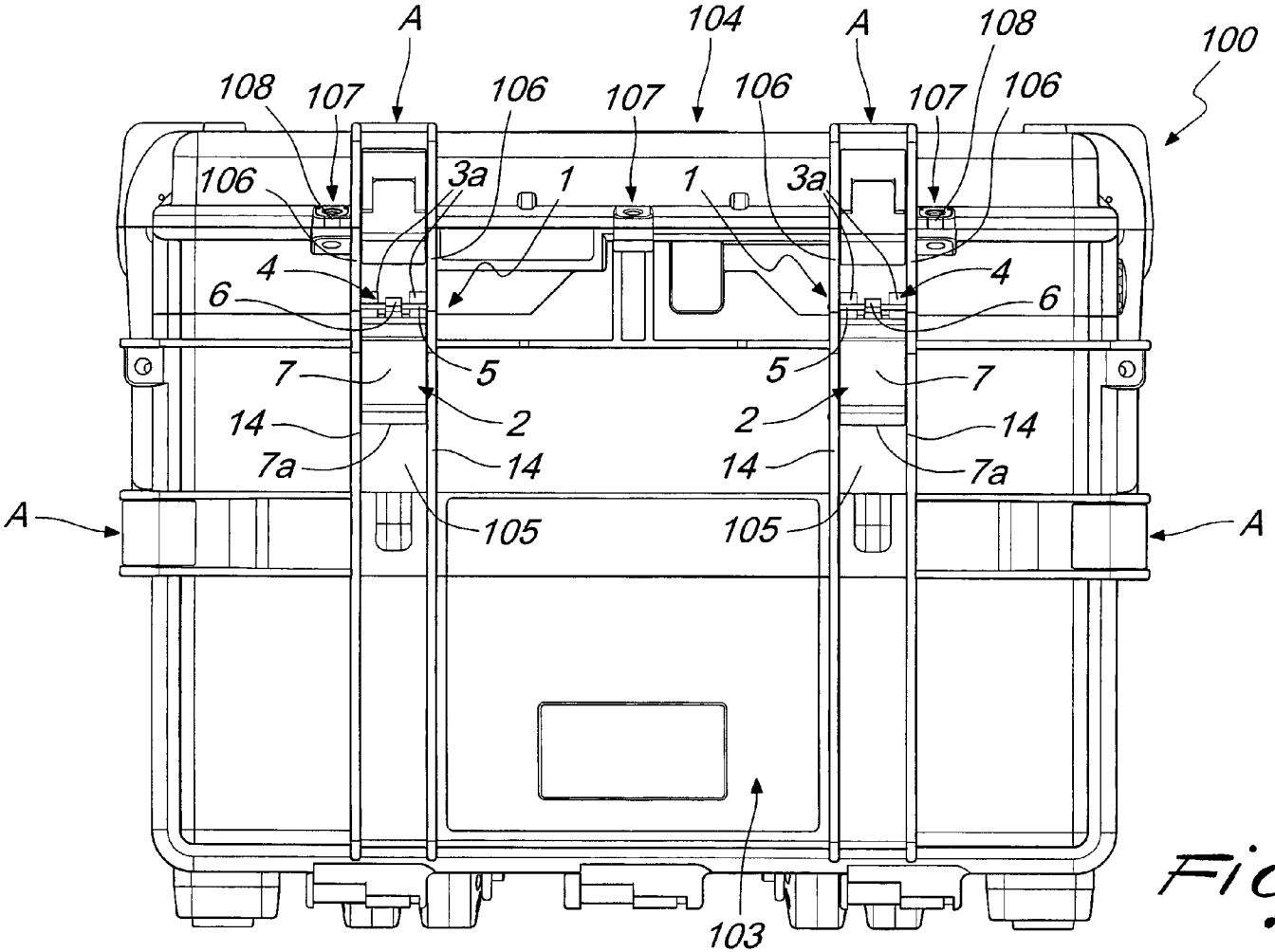
FIG. 4 is a front elevation view of the container in FIG. 3.
Figure 5:
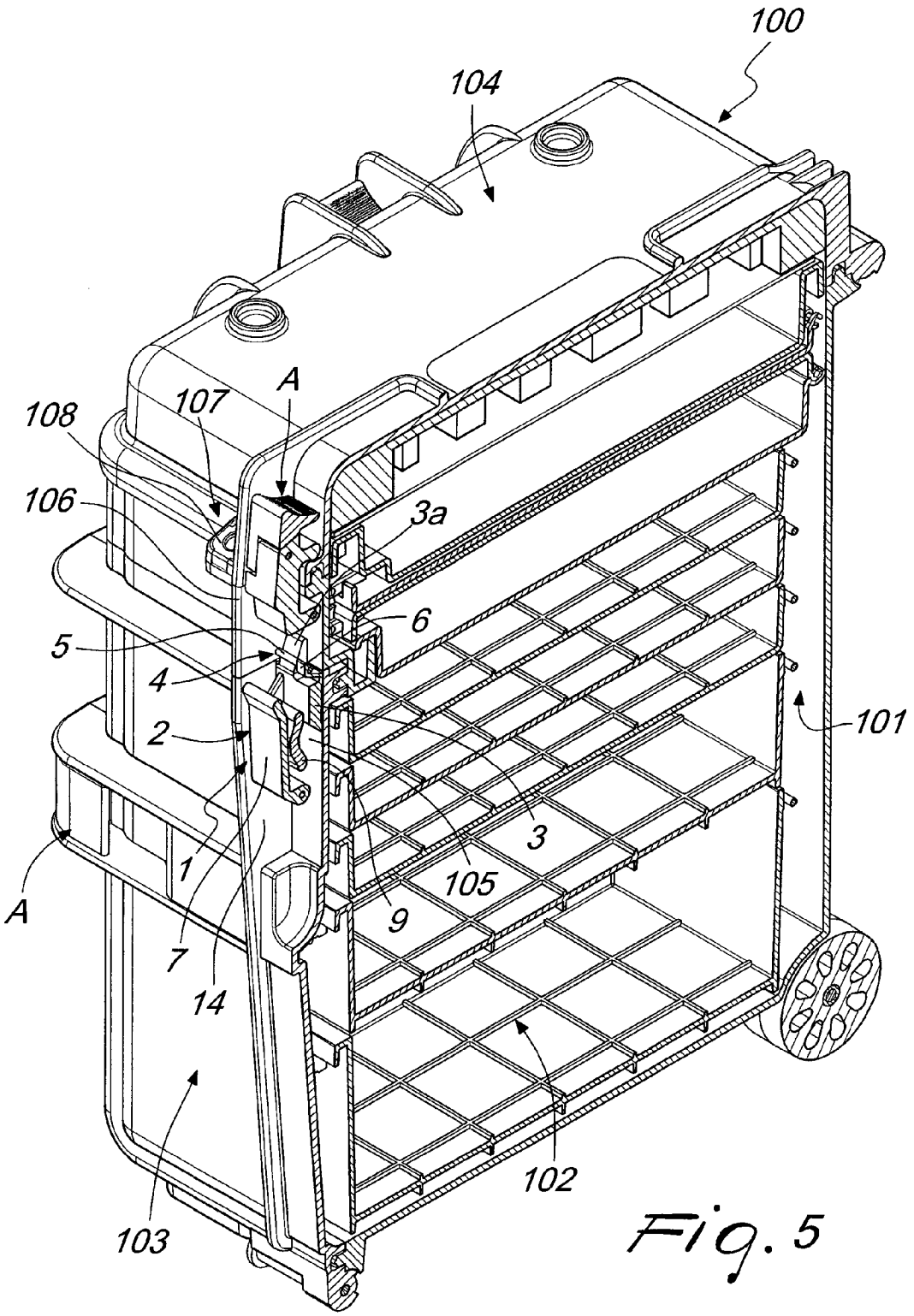
FIG. 5 is a cross-sectional view of the container in FIG. 3, taken along a plane that is perpendicular to the reference surface and passes through the slider.
Figure 6:
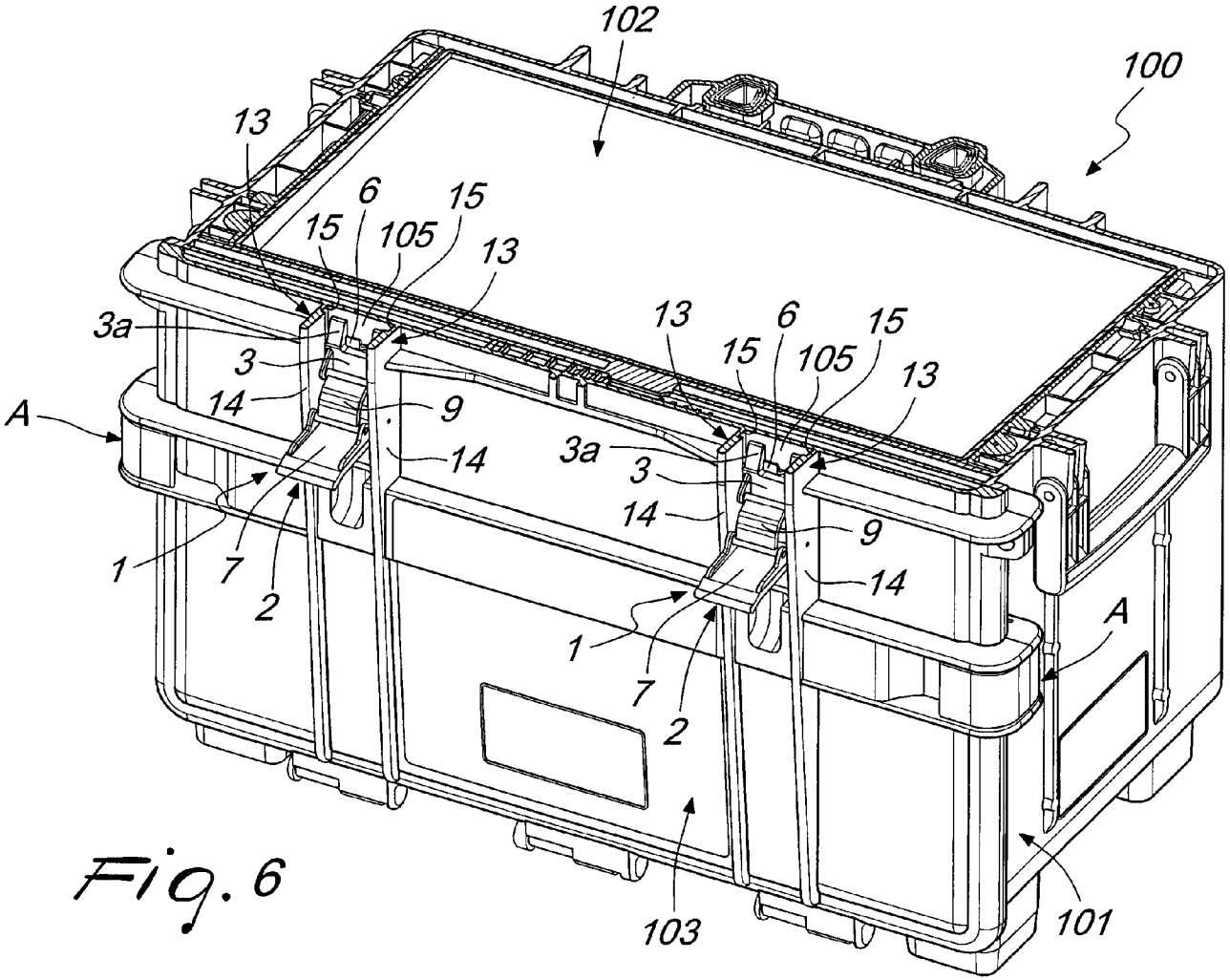
FIG. 6 is a perspective view of the container according to the disclosure, in the first configuration, with the sliders in the second limit position, cross-sectioned along a plane that is perpendicular to the covering unit.
Figure 7:
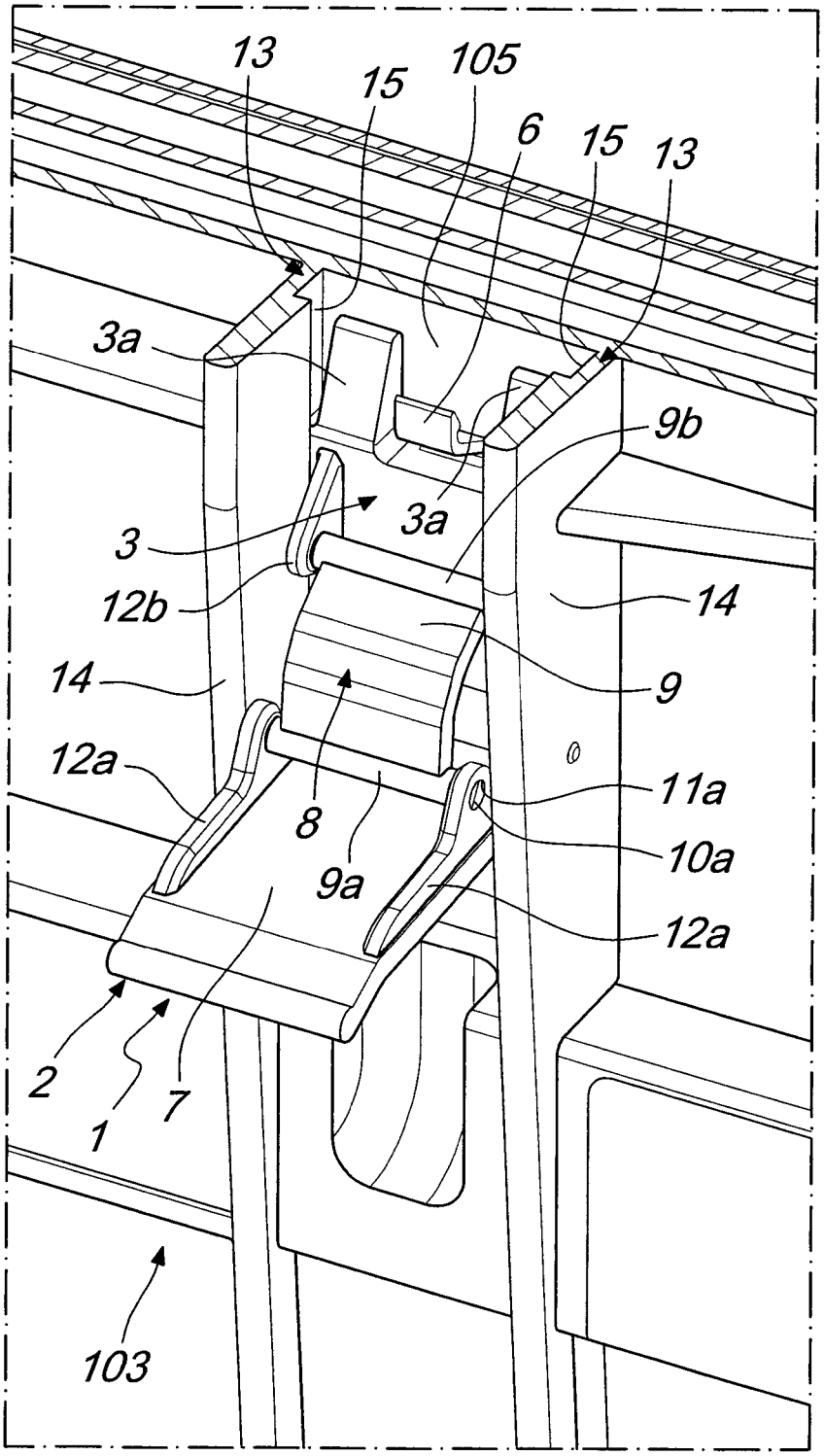
FIG. 7 is a greatly enlarged detail of FIG. 6.

In the first limit position, in which the slider 3 is illustrated in FIGS. 3, 4 and 5 (and incidentally in FIG. 1), thanks to the engagement with the abutment 4 the assembly 1 ensures the mutual locking of the shell 101 and of the unit 103, while in the second limit position, in which the slider 3 is illustrated in FIGS. 6 and 7 (and incidentally in FIG. 2) and is disengaged from the abutment 4, the assembly 1 allows the transition of the unit 103 from the first configuration to the second configuration and free access to the compartment 102.

It should be noted that in the preferred embodiment, shown in the accompanying figures, the slider 3 is slideably coupled to a reference outer surface 105 that forms part of the unit 103, while the abutment 4 is rigidly coupled to the shell 101 (according to methods that will be explained below). The disclosure includes embodiments in which the slider 3 is slideably applied to the shell 101, while the abutment 4 is coupled to the covering unit 103.

In particular, the slider 3 has at least one end protrusion provided with at least one surface portion that is inclined, with respect to the direction of movement of the slider 3 (and to the plane defined by the unit 103), so as to define a sort of wedge 3*a*.

Thus, during the transition of the slider 3 from the second limit position to the first limit position, while the slider 3 proper slides along the reference outer surface 105 of the unit 103, the wedge 3*a* can slide under the abutment 4, which is constituted by a transverse pin 5, which can be rigidly supported by corresponding first ribs 106, which are mutually aligned and which protrude externally from the container 100 (and more precisely from the shell 101, in the solution illustrated in the accompanying figures).

In this manner, at least in the first limit position the wedge 3*a* exerts a thrust on the pin 5 and forces the mutual locking of the shell 101 (to which the pin 5 is coupled) and of the covering unit 103 (to which the slider 3 provided with the wedge 3*a* is slidingly coupled). Furthermore, at least in the first limit position, the wedge 3*a* opposes by interference any possible subsequent transition of the unit 103 from the first configuration to the second configuration.

As an alternative or in addition to the solution proposed above, the slider 3 comprises an end hook 6, which, at the first limit position, engages stably, by elastic deformation, with the respective abutment 4, which in turn is constituted by the transverse pin 5.

Although it is possible to provide assemblies 1 in which the slider 3 has only the hook 6 or only one or more wedges 3*a*, in the preferred embodiment, which is shown in the accompanying figures by way of non-limiting example, the slider 3 comprises the end hook 6, which is interposed between two end protrusions, which are mutually side by side and define respective wedges 3*a*, so as to obtain an optimal locking of the covering unit 103 to the shell 101, by way of the joint action of the two wedges 3*a* and of the hook 6, which all operate in association with the same pin 5.

In more detail, during the transition from the second limit position to the first limit position, the wedges 3*a* are progressively slid under the pin 5, thus exerting a thrust against the latter, and thus they bring the shell 101 (which is coupled to the pin 5) into forced abutment against the covering unit 103 (on which the slider 3 slides), thus determining their mutual locking.

When the slider 3 reaches the first limit position, the hook 6 engages by elastic deformation with the pin 5, thus stabilizing the coupling between the shell 101 and the covering unit 103 (together with the action of the wedges 3*a*, which by interference oppose the movement of the unit 103) and thus ensuring an optimal locking and closure.

More specifically, the actuation lever 2 comprises a contoured plate 7, which has a first edge 7*a* that can be articulated, about a first rotation axis B, to the reference outer surface 105.

Furthermore, the slider 3 is controlled by the lever 2 by way of a respective kinematic mechanism 8, in order to obtain the controlled transition from the first limit position to the second limit position, and vice versa, following a rotation, about the first axis B, impressed by a user upon the lever 2.

So, the user can grip the plate 7, preferably at the opposite end with respect to the first edge 7*a*, and impress a rotation (bringing the lever 2 from the angular arrangement in FIG. 1 to that in FIG. 2), in order to command the sliding of the slider 3 on the outer surface 105 from the first limit position to the second limit position, thus disengaging the hook 6 from the pin 5 (in order to allow the movement of the unit 103), and sliding out the wedges 3*a*, and vice versa.

In the preferred embodiment, shown in the accompanying figures for the purposes of non-limiting example of the application of the disclosure, the kinematic mechanism 8 comprises a bridge 9, a first end limb 9*a* of which is articulated, about a second rotation axis C that is parallel to the first axis B, to the plate 7. Furthermore, a second end limb 9*b* of the bridge 9, opposite from the first limb 9*a*, is articulated to the slider 3, about a third rotation axis D, parallel to the first axis B and to the second axis C.

Figure 1:
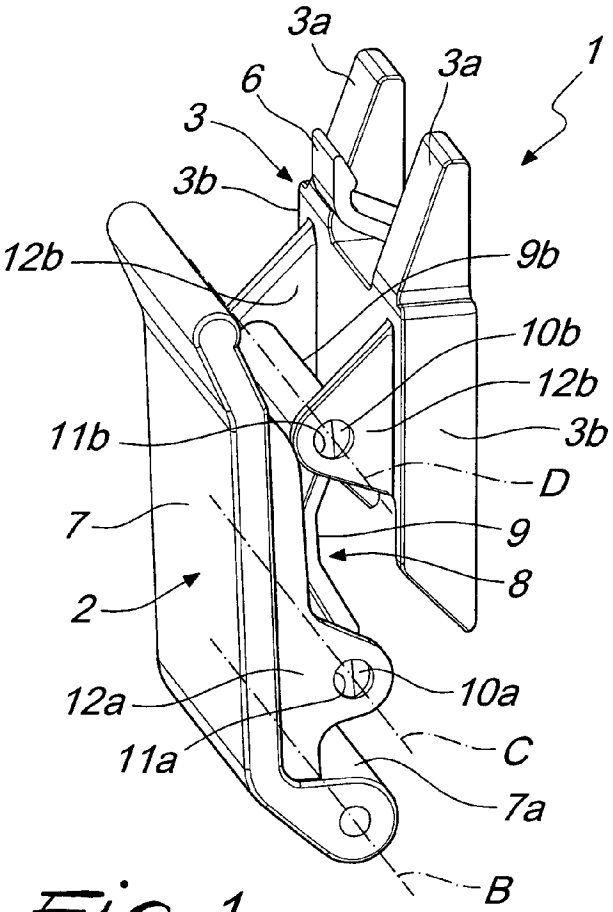

More specifically, as can be seen for example in FIGS. 1 and 2, the first end limb 9*a* and the second end limb 9*b* of the bridge 9 are substantially constituted by cylindrical enlargements that are arranged respectively along the second axis C and the third axis D. Furthermore, there are, extending from opposite ends of the enlargements, along the second axis C and the third axis D, respective shanks 10*a* and 10*b* which are rotatably insertable (in order to obtain the desired articulation of the bridge 9 to the lever 2 and to the slider 3) into corresponding slots 11*a* and 11*b* which are provided in mutually facing side walls 12*a*, 12*b* respectively of the lever 2 and of the slider 3.

Conveniently, the locking assembly 1 comprises means 13 for guiding the sliding of the slider 3 along the reference outer surface 105, during the transition from the first limit position to the second limit position, and vice versa.

In particular, such guiding means 13 comprise at least one second rib 14, which is fixed at right angles to the reference outer surface 105, and oriented parallel to the sliding path of the slider 3. The second rib 14 thus has a track 15, which in turn is parallel to the path of the slider 3, and which constitutes a guide rail for a respective flank 3*b* of the slider 3, during the transition from the first limit position to the second limit position, and vice versa.

More specifically, the guiding means 13 comprise two second ribs 14, which face each other on opposite sides of the slider 3 (and are aligned with the first ribs 106, as can be seen from the accompanying figures): each second rib 14 thus has a respective track 15, which constitutes a guide rail for a corresponding flank 3*b* of the slider 3, during the transition from the first limit position to the second limit position, and vice versa.

In the accompanying figures, which show the preferred embodiment, each track 15 is arranged at the base of the respective second rib 14, but the possibility is not ruled out, of providing tracks 15 at any height, according to specific requirements. Furthermore, it is possible for the tracks 15 to be extended, at least partially, along the first ribs 106 as well.

Conveniently, the locking assembly 1 according to the disclosure comprises a selective locking device, a key-operated mechanism for example, and/or a padlock, which is activateable when the slider 3 is arranged in the first limit position and is deactivateable on command: the device is normally arranged so as to interfere with the free rotation of the actuation lever 2, in order to prevent the transition of the unit 103 from the first configuration to the second configuration and free (unwanted) access to the compartment 102.

If the device is constituted by a key-operated mechanism, it thus makes it possible to prevent a third party, not in possession of the key, from moving the unit 103 and accessing whatever is accommodated in the compartment 102, since it is impossible to actuate the lever 2 in order to bring the slider 3 to the second limit position, thus disengaging the hook 6 and sliding out the wedges 3*a*.

Thus the present discussion also relates to a portable container, of the type of trunks, suitcases, trolley cases, and the like, which comprises at least one open shell 101 which defines internally a compartment 102 for accommodating objects; the shell 101, as has previously been seen, is at least partially closed, in at least one first configuration, by at least one respective covering unit 103, which is coupled to the shell 101 and can move between the first configuration and at least one second configuration, in which it allows a user free access to the compartment 102.

According to the disclosure, the container 100 comprises a locking assembly 1 that is provided with at least one lever 2 for actuating at least one slider 3, which is slideably coupled to a reference outer surface 105 of either the shell 101 or of the covering unit 103 (and for example of the unit 103).

Furthermore, the slider 3 can move between at least one first limit position and a second limit position: in the first limit position the slider 3 is engaged with a respective abutment 4 that is coupled to the other one of either the shell 101 or the unit 103 (and for example to the shell 101), in order to ensure their mutual locking (according to for example the methods described in full detail in the previous pages), while in the second position the slider 3 is distanced from the abutment 4, in order to allow the transition of the unit 103 from the first configuration to the second configuration and thus allow (a user) free access to the compartment 102.

Conveniently, the container 100 has a pair of respectively aligned first ribs 106 that protrude externally (from the shell 101 and in any case from the container 100) and which define a rigid support for a transverse pin 5, which constitutes the abutment 4.

Conveniently, the container 100 comprises means 13 for guiding the sliding of the slider 3 along the reference outer surface 105, during the transition from the first limit position to the second limit position, and vice versa.

More specifically, the guiding means 13 comprise a pair of second ribs 14, which face each other on opposite sides of the slider 3 and are fixed at right angles to the reference outer surface 105, according to an orientation that is parallel to the sliding path of the slider 3 proper.

The second ribs 14, which are aligned with the first ribs 106, thus have respective tracks 15, which are parallel to the aforementioned path, and which constitute guide rails for respective flanks 3*b* of the slider 3, during the transition from the first limit position to the second limit position, and vice versa.

Operation of the lock and of the container according to the disclosure is the following.

As has been seen, the unit 103 (which is articulated to the shell 101, at the opposite end with respect to the perimetric flap 103*a*) can be brought by a user from the first configuration to the second configuration, in order to allow access to the compartment 102.

Moreover, it should be noted that in the peculiar embodiments shown in the accompanying figures, the unit 103 is arranged to close a front window of the shell 101, which is also open above (where it is closed by an additional cover 104, which is acted upon by locking elements A of the conventional type, although the possibility is not ruled out of substituting them with further assemblies 1 according to the disclosure).

It should be emphasized that one or more locking assemblies 1 according to the disclosure can be employed in order to mutually lock two parts of a container 100, no matter what type it is (and thus even, for example, in order to lock closed two conventional half-shells which are mutually articulated).

In any case, when the slider 3 (which is slideably coupled to the unit 103) is in the first limit position (and the unit 103 is in the first configuration), the hook 6 is stably engaged, by elastic deformation, with the abutment 4 (the pin 5), which is rigidly supported by the first ribs 106 (and thus secured to the shell 101). At the same time, the wedges 3*a* exert a thrust on the pin 5 (which is coupled, as has been seen, to the shell 101) and by interference oppose the movement of the unit 103 with respect to the shell 101, thus in turn ensuring the mutual locking of the shell 101 and of the covering unit 103.

Therefore, as long as the slider 3 is kept in the first limit position, it ensures the maintaining of the first configuration, in which the unit 103 at least partially closes the shell 101 (and the container 100).

If a user wants to gain access to the compartment 102 through the window that is closed by the unit 103, or in any case wants to move the latter item, he/she can simply act on the actuation lever 2, thus causing the rotation thereof about the first axis B.

In fact, the rotation of the lever 2 determines, by means of the kinematic mechanism 8 that comprises the bridge 9, the sliding of the slider 3 along the reference outer surface 105 of the unit 103 (thanks to the second ribs 14 which guide the flanks 3*b* of the slider 3 with their tracks 15). The slider 3 disengages from the abutment 4 and thus retreats toward the second limit position, in which, now distanced from the abutment 4, it does not obstruct the movement of the unit 103 (possibly after having also acted on other locking elements A, if provided), which thus can be brought to the second configuration, in order to gain access to the compartment 102.

It can thus be seen that one or more locking assemblies 1 ensure the locking of containers 100, while at the same time ensuring contained dimensions and space occupation.

It should be noted in fact that the slider 3, which has the task of ensuring the mutual locking of the shell 101 and of the unit 103, can only perform a translational (sliding) motion along the reference outer surface 105.

Therefore, both in the two limit positions, and also during the transition from the one to the other, and vice versa, the slider 3 protrudes only minimally from the space occupation of the container 100, without thus significantly interfering with any other components and accessories of the latter (as occurs with conventional assemblies, such as for example the elements A, in which the elements for locking need to be rotated in order to be made to clamp together perimetric lips of the half-shells to be coupled).

Furthermore, the mutual locking of the shell 101 and of the unit 103 is ensured by the stable coupling of the hook 6 with the pin 5 and by the action of the wedges 3*a*: therefore, differently from what happens with conventional assemblies, it is not necessary to make complex modifications to the container 100, in order to provide it with perimetric lips that protrude from each half-shell, which are acted on by elements (clamps) adapted for locking.

It should further be noted that thanks to the use of a kinematic mechanism 8, which comprises a bridge 9 that is articulated both to the lever 2 and also to the slider 3, it is possible to transmit to the slider 3 the force necessary to ensure the elastic deformation responsible for the engagement/disengagement of the hook 6 with/from the abutment 4 (and the thrust of the wedges 3*a* upon the latter), against a minimal effort required of the user. It is in fact sufficient to conveniently dimension the lever arms of the forces in play (while appropriately selecting the mutual distance between the rotation axes B, C and D), in order to achieve the desired coupling (and the corresponding decoupling), by exerting a minimal traction or a minimal pressure on the lever 2, in order to produce its desired rotation.

This thus confers high practicality and manageability on the locking assembly 1, while guarding against the need to overdimension the elements responsible for mutual locking and for keeping space occupation low.

The advantages highlighted above (low space occupation and minimal force required of the user, by conveniently selecting the mutual distance between the rotation axes B, C and D) render the assembly 1 according to the disclosure absolutely versatile, and therefore also adapted for use on large containers 100 that are sufficiently robust to ensure high resistance to shocks and are provided with gaskets for a total hermetic seal.

In fact, even in such eventualities, it is obviously possible to select the mutual distances between the axes A, B and C so as to ensure the action of the hook 6 and of the wedges 3*a* on the pin 5 even against a modest force required of the user, and without having to overdimension the lever 2 and/or the slider 3. Furthermore, the limited space occupation makes it possible to provide any desired number of locking assemblies 1 on the container 100, so as to be able to develop, as needed, a high locking force, without their interfering with each other or with other accessories and components.

Moreover, if adapted perimetric sealing gaskets are arranged between the shell 101 and the covering unit 103, then when the wedges 3*a* exert their action on the pin 5 during the transition between the second limit position and the first limit position, the mutual locking between the shell 101 and the covering unit 103 makes one of these to compress the gasket, flattening it against the other, thus obtaining an excellent seal and a perfectly hermetic closure.

In practice it has been found that the locking assembly and the container according to the disclosure fully achieve the set aim and objects, in that the use of a lever in order to actuate a slider, which can be slideably coupled to a reference outer surface of either the shell or the covering unit, and can move between a first limit position, in which it is engaged with a respective abutment which can be coupled to the other one of either the shell or the unit, and at least one second limit position, in which the slider is distanced from the abutment, makes it possible to provide a locking assembly for containers, which offers contained dimensions and space occupation.

The disclosure, thus conceived, is susceptible of numerous modifications and variations. Moreover, all the details may be substituted by other, technically equivalent elements.

In the embodiments illustrated, individual characteristics shown in relation to specific examples may in reality be interchanged with other, different characteristics, existing in other embodiments.

For example, along the container 100 one or more hasps 107 can be arranged for padlocks or such contrivances.

Such hasps 107 can comprise mutually aligned holes provided in tabs that protrude from the shell 101, from the cover 104 and/or from the covering unit 103: in the accompanying figures two variations of embodiment in this regard are shown, in one of which three hasps 107 side by side (provided in tabs that protrude from the shell 101 and from the cover 104) are all provided with metallic stiffening cores 108 (see for example FIG. 8), while in the other the central hasp 107 does not have this characteristic (see for example FIGS. 3 and 4).

In practice, the materials employed, as well as the dimensions, may be any according to requirements and to the state of the art.

The invention claimed is:

1. A locking assembly for portable containers, the locking assembly comprises at least one open shell that internally defines a compartment for objects and is at least partially closed, in at least one first configuration, by at least one respective covering unit, which is coupled to the shell and moves between the first configuration and at least one second configuration, for free access to the compartment, and further comprising at least one lever for actuating at least one slider, which can be slideably coupled to a reference outer surface of either the shell or said at least one respective covering unit, said slider being movable between at least one first limit position, wherein the slider is engaged with a respective abutment which can be coupled to the other one of either the shell or said at least one respective covering unit, arranged in the first configuration, for their mutual locking, and at least one second limit position, in which said slider is distanced from said abutment, in order to allow a transition of the covering unit from the first configuration to the second configuration and free access to the compartment, wherein said slider has at least one end protrusion that has at least one surface portion that is inclined, with respect to the direction of movement of said slider, in order to define a wedge, during the transition of said slider from said second limit position to said first limit position said wedge being slid under said abutment, said abutment being constituted by a transverse pin, which can be rigidly supported by corresponding first ribs, which are mutually aligned and protrude externally from the container, in order to exert a thrust on said pin and force the mutual locking of said shell and of said covering unit and in order to oppose by interference any possible subsequent transitioning from said first configuration to said second configuration.

2. The locking assembly according to claim 1, wherein said slider comprises an end hook, at said first limit position said hook being stably engaged, by elastic deformation, with said respective abutment, said abutment being constituted by a transverse pin, which can be rigidly supported by corresponding first ribs, which are mutually aligned and protrude externally from the container.

3. The locking assembly according to claim 2, wherein said slider comprises said end hook, interposed between two of said end protrusions, which are mutually side by side and define respective wedges.

4. The locking assembly according to claim 1, wherein said at least one lever comprises a contoured plate, a first edge of said plate being capable of being articulated, about a first rotation axis, to the reference outer surface, said slider being controlled by said lever by way of a respective kinematic mechanism, for the controlled transition from said first limit position to said second limit position, and vice versa, following a rotation, about said first axis, impressed by a user upon said lever.

5. The locking assembly according to claim 4, wherein said kinematic mechanism comprises a bridge, a first end limb of said bridge being articulated, about a second rotation axis that is parallel to said first axis, to said plate, a second end limb of said bridge, which is opposite with respect to said first limb, being articulated to said slider, about a third rotation axis that is parallel to said first axis and to said second axis.

6. The locking assembly according to claim 5, wherein said first end limb and said second end limb of said bridge are substantially constituted by cylindrical enlargements that are arranged respectively along said second axis and said third axis, there being, extending from opposite ends of said enlargements, along said second axis and said third axis, respective shanks that can be rotatably inserted into corresponding slots that are provided in mutually facing side walls respectively of said lever and of said slider.

7. The locking assembly according to claim 1, further comprising means for guiding the sliding of said slider along the reference outer surface, during the transition from said first limit position to said second limit position, and vice versa.

8. The locking assembly according to claim 7, wherein said guiding means comprise at least one second rib, which can be fixed perpendicularly to the reference outer surface, parallel to the sliding path of said slider, said at least one second rib having a track, parallel to said path, that constitutes a guide rail for a respective flank of said slider, during the transition from said first limit position to said second limit position, and vice versa.

9. The locking assembly according to claim 8, wherein said guiding means comprise two of said second ribs, which face each other on opposite sides of said slider and can respectively be aligned with the first ribs, each one of said second ribs having a respective said track that constitutes a said guide rail for a corresponding said flank of said slider, during the transition from said first limit position to said second limit position, and vice versa.

10. A portable container comprising at least one open shell that internally defines a compartment for objects and is at least partially closed, in at least one first configuration, by at least one respective covering unit, which is coupled to said shell and can move between said first configuration and at least one second configuration, for free access to said compartment, and further comprising the locking assembly of claim 1 .

11. The portable container according to claim 10, further comprising a pair of mutually aligned first ribs, which protrude externally and define a rigid support for a transverse pin, which constitutes said abutment.

12. The portable container according to claim 10, further comprising means for guiding the sliding of said slider along the reference outer surface, during the transition from said first limit position to said second limit position, and vice versa.

13. The portable container according to claim 12, wherein said guiding means comprise a pair of second ribs which face each other on opposite sides of said slider and are perpendicularly fixed to said reference outer surface, parallel to the sliding path of said slider, said second ribs, which are aligned with said first ribs, having respective tracks that are parallel to said path and constitute guide rails for respective flanks of said slider, during the transition from said first limit position to said second limit position, and vice versa.

* * * * *